US008703377B2

(12) United States Patent
Veregin et al.

(10) Patent No.: US 8,703,377 B2
(45) Date of Patent: Apr. 22, 2014

(54) EMULSION AGGREGATION TONER COMPOSITIONS

(75) Inventors: Richard P. N. Veregin, Mississauga (CA); Kimberly D Nosella, Mississauga (CA); Cuong Vong, Hamilton (CA); Abdisamed Sheik-Qasim, Etobicoke (CA); Melanie Davis, Hamilton (CA); Suxia Yang, Mississauga (CA); Majid Kamel-Kasmaei, North York (CA); Paul J Gerroir, Oakville (CA)

(73) Assignee: Xerox Corporation, Norwalk, CT (US)

( * ) Notice: Subject to any disclaimer, the term of this patent is extended or adjusted under 35 U.S.C. 154(b) by 309 days.

(21) Appl. No.: 13/021,191

(22) Filed: Feb. 4, 2011

(65) Prior Publication Data

US 2012/0202148 A1 Aug. 9, 2012

(51) Int. Cl.
*G03G 9/00* (2006.01)

(52) U.S. Cl.
USPC ..... 430/110.2; 430/109.4; 430/137.14

(58) Field of Classification Search
USPC ..... 430/109.1, 109.4, 110.2, 137.14
See application file for complete search history.

(56) References Cited

U.S. PATENT DOCUMENTS

| | | | | |
|---|---|---|---|---|
| 5,147,744 | A * | 9/1992 | Sacripante et al. | 430/39 |
| 7,183,034 | B2 * | 2/2007 | Kamada et al. | 430/123.5 |
| 2002/0142241 | A1 * | 10/2002 | Palmer | 430/110.2 |
| 2009/0047591 | A1 * | 2/2009 | McDougall et al. | 430/109.3 |
| 2010/0297546 | A1 | 11/2010 | Zhou et al. | |

* cited by examiner

*Primary Examiner* — Stewart Fraser
(74) *Attorney, Agent, or Firm* — MDIP LLC

(57) ABSTRACT

Disclosed is a toner which comprises particles comprising: (a) a core comprising: (1) a first resin; and (2) a first conductive colorant; and (b) a shell comprising: (1) a second resin; and (2) a second conductive colorant.

19 Claims, 1 Drawing Sheet

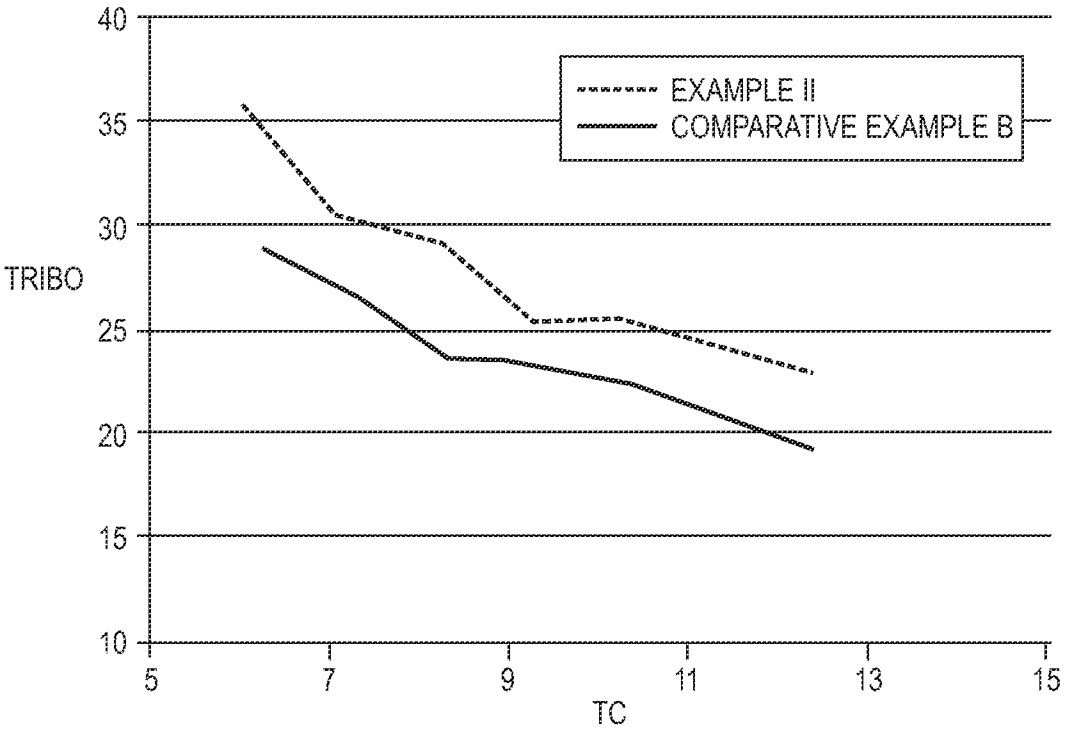
EXAMPLE II
COMPARATIVE EXAMPLE B
TRIBO
40
35
30
25
20
15
10
5
7
9
11
13
15
TC

EMULSION AGGREGATION TONER COMPOSITIONS

BACKGROUND

Disclosed herein are toners prepared by emulsion aggregation processes and exhibiting desirable charging characteristics. More specifically, disclosed herein are emulsion aggregation toners having a core-shell structure with a conductive component in the shell.

The formation and development of images on the surface of photoconductive materials by electrostatic means is well known. The basic electrophotographic imaging process, as taught by C. F. Carlson in U.S. Pat. No. 2,297,691, entails placing a uniform electrostatic charge on a photoconductive insulating layer known as a photoconductor or photoreceptor, exposing the photoreceptor to a light and shadow image to dissipate the charge on the areas of the photoreceptor exposed to the light, and developing the resulting electrostatic latent image by depositing on the image a finely divided electroscopic material known as toner. Toner typically comprises a resin and a colorant. The toner will normally be attracted to those areas of the photoreceptor which retain a charge, thereby forming a toner image corresponding to the electrostatic latent image. This developed image may then be transferred to a substrate such as paper. The transferred image may subsequently be permanently affixed to the substrate by heat, pressure, a combination of heat and pressure, or other suitable fixing means such as solvent or overcoating treatment.

Numerous processes are within the purview of those skilled in the art for the preparation of toners. Emulsion aggregation (EA) is one such method. Emulsion aggregation toners can be used in forming print and/or xerographic images. Emulsion aggregation techniques can entail the formation of an emulsion latex of the resin particles by heating the resin, using emulsion polymerization, as disclosed in, for example, U.S. Pat. No. 5,853,943, the disclosure of which is totally incorporated herein by reference. Other examples of emulsion/aggregation/coalescing processes for the preparation of toners are illustrated in, for example, U.S. Pat. Nos. 5,278,020, 5,290,654, 5,302,486, 5,308,734, 5,344,738, 5,346,797, 5,348,832, 5,364,729, 5,366,841, 5,370,963, 5,403,693, 5,405,728, 5,418,108, 5,496,676, 5,501,935, 5,527,658, 5,585,215, 5,650,255, 5,650,256, 5,723,253, 5,744,520, 5,747,215, 5,763,133, 5,766,818, 5,804,349, 5,827,633, 5,840,462, 5,853,944, 5,863,698, 5,869,215, 5,902,710; 5,910,387; 5,916,725; 5,919,595; 5,925,488, 5,977,210, 5,994,020, 6,576,389, 6,617,092, 6,627,373, 6,638,677, 6,656,657, 6,656,658, 6,664,017, 6,673,505, 6,730,450, 6,743,559, 6,756,176, 6,780,500, 6,830,860, and 7,029,817, and U.S. Patent Publication No. 2008/0107989, the disclosures of which are totally incorporated herein by reference.

Polyester EA ultra low melt (ULM) toners have been prepared utilizing amorphous and crystalline polyester resins as disclosed in, for example, U.S. Pat. No. 7,547,499, the disclosure of which is totally incorporated herein by reference.

Two exemplary emulsion aggregation toners include acrylate based toners, such as those based on styrene acrylate toner particles as illustrated in, for example, U.S. Pat. No. 6,120,967, and polyester toner particles, as disclosed in, for example, U.S. Pat. Nos. 5,916,725 and 7,785,763 and U.S. Patent Publication 2008/0107989, the disclosures of each of which are totally incorporated herein by reference.

While known compositions and processes are suitable for their intended purposes, a need remains for improved toners. In addition, a need remains for toners with improved triboelectric charging performance. Further, a need remains for toners that exhibit reduced dielectric loss. Additionally, a need remains for toners that enable improved image quality. A need also remains for toners that develop images with reduced mottle. In addition, a need remains for toners that exhibit good transfer efficiency, including transfer efficiency from an imaging member to an intermediate transfer member and from the intermediate transfer member to a final recording medium, such as paper or transparency material. Further, a need remains for toners that exhibit the aforementioned advantages while also containing relatively high concentrations of colorant. Additionally, a need remains for toners that can exhibit the aforementioned advantages while being produced at reduced cost.

SUMMARY

Disclosed herein is a toner which comprises particles comprising: (a) a core comprising: (1) a first resin; and (2) a first conductive colorant; and (b) a shell comprising: (1) a second resin; and (2) a second conductive colorant.

BRIEF DESCRIPTION OF THE DRAWING

The FIGURE is a plot of tribo versus toner concentration for the toners of Example II and Comparative Example B.

DETAILED DESCRIPTION

Resins

The toners disclosed herein can be prepared from any desired or suitable resins suitable for use in forming a toner. Such resins, in turn, can be made of any suitable monomer or monomers. Suitable monomers useful in forming the resin include, but are not limited to, styrenes, acrylates, methacrylates, butadienes, isoprenes, acrylic acids, methacrylic acids, acrylonitriles, esters, diols, diacids, diamines, diesters, diisocyanates, mixtures thereof, and the like.

Examples of suitable polyester resins include, but are not limited to, sulfonated, non-sulfonated, crystalline, amorphous, combinations thereof, and the like. The polyester resins can be linear, branched, combinations thereof, and the like. Polyester resins can include those resins disclosed in U.S. Pat. Nos. 6,593,049 and 6,756,176, the disclosures of each of which are totally incorporated herein by reference. Suitable resins also include mixtures of amorphous polyester resins and crystalline polyester resins as disclosed in U.S. Pat. No. 6,830,860, the disclosure of which is totally incorporated herein by reference.

Other examples of suitable polyesters include those formed by reacting a diol with a diacid or diester in the presence of an optional catalyst. For forming a crystalline polyester, suitable organic diols include, but are not limited to, aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, ethylene glycol, combinations thereof, and the like. The aliphatic diol can be selected in any desired or effective amount, in one embodiment at least about 40 mole percent, in another embodiment at least about 42 mole percent and in yet another embodiment at least about 45 mole percent, and in one embodiment no more than about 60 mole percent, in another embodiment no more than about 55 mole percent, and in yet another embodiment no more than about 53 mole percent, and the alkali sulfo-aliphatic diol can be selected in any desired or effective amount, in one embodiment 0 mole percent, and in another embodiment no more than about 1 mole percent, and in one embodiment no more than about 10 mole percent, and in another embodiment no more than from about 4 mole percent of the resin, although the amounts can be outside of these ranges.

Examples of suitable organic diacids or diesters for preparation of crystalline resins include, but are not limited to, oxalic acid, succinic acid, glutaric acid, adipic acid, suberic acid, azelaic acid, fumaric acid, maleic acid, dodecanedioic acid, sebacic acid, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof, and the like, as well as combinations thereof. The organic diacid can be selected in any desired or effective amount, in one embodiment at least about 40 mole percent, in another embodiment at least about 42 mole percent, and in yet another embodiment at least about 45 mole percent, and in one embodiment no more than about 60 mole percent, in another embodiment no more than about 55 mole percent, and in yet another embodiment no more than about 53 mole percent, although the amounts can be outside of these ranges.

Examples of suitable crystalline resins include, but are not limited to, polyesters, polyamides, polyimides, polyolefins, polyethylene, polybutylene, polyisobutyrate, ethylene-propylene copolymers, ethylene-vinyl acetate copolymers, polypropylene, and the like, as well as mixtures thereof. Specific crystalline resins can be polyester based, such as poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), alkali copoly(5-sulfoisophthaloyl)-copoly(ethylene-adipate), poly(decylene-sebacate), poly(decylene-decanoate), poly-(ethylene-decanoate), poly-(ethylene-dodecanoate), poly(nonylene-sebacate), poly(nonylene-decanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate), and the like, as well as mixtures thereof. The crystalline resin can be present in any desired or effective amount, in one embodiment at least about 5 percent by weight of the toner components, and in another embodiment at least about 10 percent by weight of the toner components, and in one embodiment no more than about 50 percent by weight of the toner components, and in another embodiment no more than about 35 percent by weight of the toner components, although the amounts can be outside of these ranges. The crystalline resin can possess any desired or effective melting point, in one embodiment at least about 30° C., and in another embodiment at least about 50° C., and in one embodiment no more than about 120° C., and in another embodiment no more than about 90° C., although the melting point can be outside of these ranges. The crystalline resin can have any desired or effective number average molecular weight (Mn), as measured by gel permeation chromatography (GPC), in one embodiment at least about 1,000, in another embodiment at least about 2,000, and in one embodiment no more than about 50,000, and in another embodiment no more than about 25,000, although the Mn can be outside of these ranges, and any desired or effective weight average molecular weight (Mw), in one embodiment at least about 2,000, and in another embodiment at least about 3,000, and in one embodiment no more than about 100,000, and in another embodiment no more than about 80,000, although the Mw can be outside of these ranges, as determined by Gel Permeation Chromatography using polystyrene standards. The molecular weight distribution (Mw/Mn) of the crystalline resin can be of any desired or effective number, in one embodiment at least about 2, and in another embodiment at least about 3, and in one embodiment no more than about 6, and in another embodiment no more than about 4, although the molecular weight distribution can be outside of these ranges.

Examples of suitable diacid or diesters for preparation of amorphous polyesters include, but are not limited to, dicarboxylic acids, anhydrides, or diesters, such as terephthalic acid, phthalic acid, isophthalic acid, fumaric acid, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and the like, as well as mixtures thereof. The organic diacid or diester can be present in any desired or effective amount, in one embodiment at least about 40 mole percent, in another embodiment at least about 42 mole percent, and in yet another embodiment at least about 45 mole percent, and in one embodiment no more than about 60 mole percent, in another embodiment no more than about 55 mole percent, and in yet another embodiment no more than about 53 mole percent of the resin, although the amounts can be outside of these ranges.

Examples of suitable diols for generating amorphous polyesters include, but are not limited to, 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis(2-hydroxyethyl)oxide, dipropylene glycol, dibutylene glycol, and the like, as well as mixtures thereof. The organic diol can be present in any desired or effective amount, in one embodiment at least about 40 mole percent, in another embodiment at least about 42 mole percent, and in yet another embodiment at least about 45 mole percent, and in one embodiment no more than about 60 mole percent, in another embodiment no more than about 55 mole percent, and in yet another embodiment no more than about 53 mole percent of the resin, although the amounts can be outside of these ranges.

Polycondensation catalysts which can be used for preparation of either the crystalline or the amorphous polyesters include, but are not limited to, tetraalkyl titanates such as titanium (iv) butoxide or titanium (iv) iso-propoxide, dialkyltin oxides such as dibutyltin oxide, tetraalkyltins such as dibutyltin dilaurate, dialkyltin oxide hydroxides such as butyltin oxide hydroxide, aluminum alkoxides, alkyl zinc, dialkyl zinc, zinc oxide, stannous oxide, and the like, as well as mixtures thereof. Such catalysts can be used in any desired or effective amount, in one embodiment at least about 0.001 mole percent, and in one embodiment no more than about 5 mole percent based on the starting diacid or diester used to generate the polyester resin, although the amounts can be outside of these ranges.

Examples of suitable amorphous resins include polyesters, polyamides, polyimides, polyolefins, polyethylene, polybutylene, polyisobutyrate, ethylene-propylene copolymers, ethylene-vinyl acetate copolymers, polypropylene, and the like, as well as mixtures thereof. Specific examples of amorphous resins which can be used include, but are not limited to, poly(styrene-acrylate) resins, crosslinked, for example, from about 10 percent to about 70 percent, poly(styrene-acrylate) resins, poly(styrene-methacrylate) resins, crosslinked poly (styrene-methacrylate) resins, poly(styrene-butadiene) resins, crosslinked poly(styrene-butadiene) resins, alkali sulfonated-polyester resins, branched alkali sulfonated-polyester resins, alkali sulfonated-polyimide resins, branched alkali sulfonated-polyimide resins, alkali sulfonated poly(styrene-acrylate) resins, crosslinked alkali sulfonated poly(styrene-acrylate) resins, poly(styrene-methacrylate) resins, crosslinked alkali sulfonated-poly(styrene-methacrylate) resins, alkali sulfonated-poly(styrene-butadiene) resins, crosslinked alkali sulfonated poly(styrene-butadiene) resins, and the like, as well as mixtures thereof. Alkali sulfonated polyester resins can be useful in embodiments, such as the metal or alkali salts of copoly(ethylene-terephthalate)-copoly(ethylene-5-sulfo-isophthalate), copoly(propylene-terephthalate)-copoly(propylene-5-sulfo-isophthalate), copoly(diethylene-terephthalate)-copoly(diethylene-5-sulfo-isophthalate), copoly(propylene-diethylene-terephthalate)-copoly(propylene-diethylene-5-sulfoisophthalate), copoly(propylene-butylene-terephthalate)-copoly(propylene-butylene-5-sulfo-isophthalate), copoly(propoxylated bisphenol-A-fumarate)-copoly(propoxylated bisphenol A-5-sulfo-isophthalate), and the like, as well as mixtures thereof.

Unsaturated polyester resins can also be used. Examples of such resins include those disclosed in U.S. Pat. No. 6,063,827, the disclosure of which is totally incorporated herein by reference. Exemplary unsaturated polyester resins include, but are not limited to, poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly (ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and the like, as well as mixtures thereof.

One specific suitable amorphous polyester resin is a poly (propoxylated bisphenol A co-fumarate) resin having the following formula:

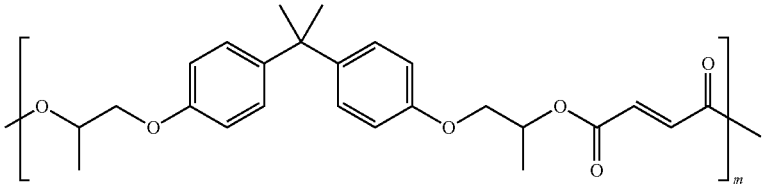

wherein m can be from about 5 to about 1000, although m can be outside of this range. Examples of such resins and processes for their production include those disclosed in U.S. Pat. No. 6,063,827, the disclosure of which is totally incorporated herein by reference.

Also suitable are the polyester resins disclosed in U.S. Pat. No. 7,528,218, the disclosure of which is totally incorporated herein by reference. Specific examples of suitable resins include (1) the polycondensation products of mixtures of the following diacids:

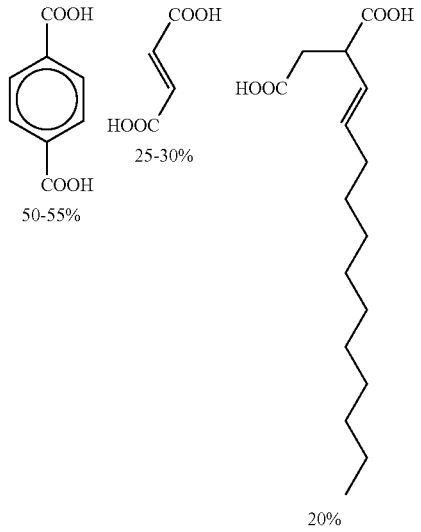

and the following diols:

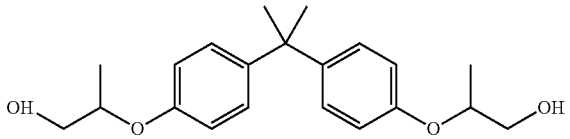

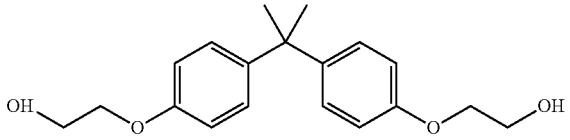

and (2) the polycondensation products of mixtures of the following diacids:

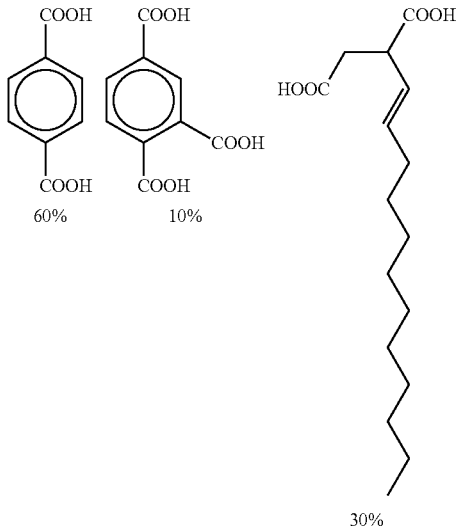

and the following diols:

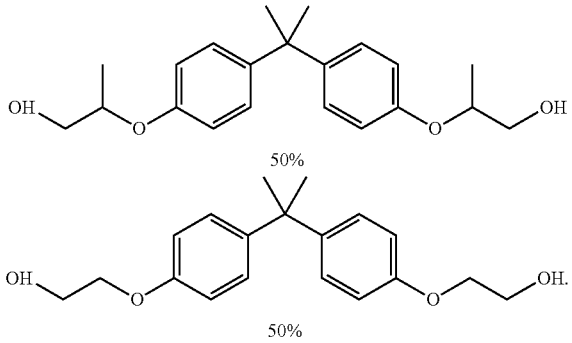

One example of a linear propoxylated bisphenol A fumarate resin which can be used as a latex resin is available under the trade name SPARII from Resana S/A Industrias Quimicas, Sao Paulo Brazil. Other propoxylated bisphenol A fumarate resins that can be used and are commercially available include GTUF and FPESL-2 from Kao Corporation, Japan, and EM181635 from Reichhold, Research Triangle Park, N.C., and the like.

Suitable crystalline resins also include those disclosed in U.S. Pat. No. 7,329,476, the disclosure of which is totally incorporated herein by reference. One specific suitable crystalline resin comprises ethylene glycol and a mixture of dodecanedioic acid and fumaric acid co-monomers with the following formula:

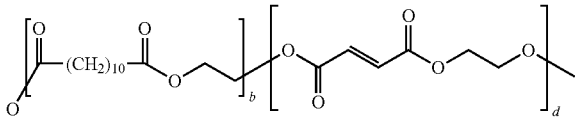

wherein b is from about 5 to about 2000 and d is from about 5 to about 2000, although the values of b and d can be outside of these ranges. Another suitable crystalline resin is of the formula

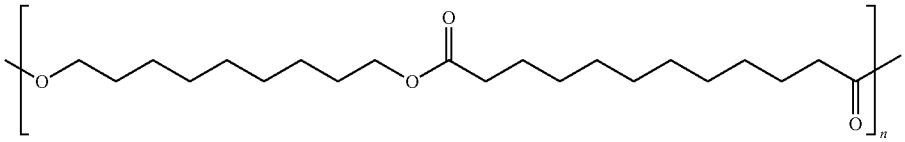

wherein n represents the number of repeat monomer units.

Examples of other suitable latex resins or polymers which can be used include, but are not limited to, poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylonitrile), and poly(styrene-butyl acrylate-acrylonitrile-acrylic acid), and the like, as well as mixtures thereof. The polymers can be block, random, or alternating copolymers, as well as combinations thereof.

Emulsification

The emulsion to prepare emulsion aggregation particles can be prepared by any desired or effective method, such as a solventless emulsification method or phase inversion process as disclosed in, for example, U.S. Patent Publications 2007/0141494 and 2009/0208864, the disclosures of each of which are totally incorporated herein by reference. As disclosed in 2007/0141494, the process includes forming an emulsion comprising a disperse phase including a first aqueous composition and a continuous phase including molten one or more ingredients of a toner composition, wherein there is absent a toner resin solvent in the continuous phase; performing a phase inversion to create a phase inversed emulsion comprising a disperse phase including toner-sized droplets comprising the molten one or more ingredients of the toner composition and a continuous phase including a second aqueous composition; and solidifying the toner-sized droplets to result in toner particles. As disclosed in 2009/0208864, the process includes melt mixing a resin in the absence of a organic solvent, optionally adding a surfactant to the resin, optionally adding one or more additional ingredients of a toner composition to the resin, adding to the resin a basic agent and water, performing a phase inversion to create a phase inversed emulsion including a disperse phase comprising toner-sized droplets including the molten resin and the optional ingredients of the toner composition, and solidifying the toner-sized droplets to result in toner particles.

Also suitable for preparing the emulsion is the solvent flash method, as disclosed in, for example, U.S. Pat. No. 7,029,817, the disclosure of which is totally incorporated herein by reference. As disclosed therein, the process includes dissolving the resin in a water miscible organic solvent, mixing with hot water, and thereafter removing the organic solvent from the mixture by flash methods, thereby forming an emulsion of the resin in water. The solvent can be removed by distillation and recycled for future emulsifications.

Any other desired or effective emulsification process can also be used.

Toner

The toner particles can be prepared by any desired or effective method. Although embodiments relating to toner particle production are described below with respect to emulsion-aggregation processes, any suitable method of preparing toner particles may be used, including chemical processes, such as suspension and encapsulation processes disclosed in U.S. Pat. Nos. 5,290,654 and 5,302,486, the disclosures of each of which are totally incorporated herein by reference. Toner compositions and toner particles can be prepared by aggregation and coalescence processes in which small-size resin particles are aggregated to the appropriate toner particle size and then coalesced to achieve the final toner-particle shape and morphology.

Toner compositions can be prepared by emulsion-aggregation processes that include aggregating a mixture of an optional colorant, an optional wax, any other desired or required additives, and emulsions including the selected resins described above, optionally in surfactants, and then coalescing the aggregate mixture. A mixture can be prepared by adding an optional colorant and optionally a wax or other materials, which can also be optionally in a dispersion(s) including a surfactant, to the emulsion, which can also be a mixture of two or more emulsions containing the resin.

Surfactants

Examples of nonionic surfactants include polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenc as IGEPAL CA-210™ IGEPAL CA-520™, IGEPAL CA-720™, IGEPAL CO-890™, IGEPAL CO-720™, IGEPAL CO-290™, IGEPAL CA-210™, ANTAROX 890™, and ANTAROX897™. Other examples of suitable nonionic surfactants include a block copolymer of polyethylene oxide and polypropylene oxide, including those commercially available as SYNPERONIC PE/F, such as SYNPERONIC PE/F 108.

Anionic surfactants include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abitic acid available from Aldrich, NEOGEN R™, NEOGEN SC™ available from Daiichi Kogyo Seiyaku, combinations thereof, and the like. Other suitable anionic surfactants include DOWFAX™ 2A1, an alkyldiphenyloxide disulfonate from Dow Chemical Company, and/or TAYCA POWER BN2060 from Tayca Corporation (Japan), which are branched sodium dodecyl benzene sulfonates. Combinations of these surfactants and any of the foregoing anionic surfactants can be used.

Examples of cationic surfactants, which are usually positively charged, include alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™, available from Alkaril Chemical Company, SANIZOL™ (benzalkonium chloride), available from Kao Chemicals, and the like, as well as mixtures thereof.

Wax

Optionally, a wax can also be combined with the resin and other toner components in forming toner particles. When included, the wax can be present in any desired or effective amount, in one embodiment at least about 1 percent by weight, and in another embodiment at least about 5 percent by weight, and in one embodiment no more than about 25 percent by weight, and in another embodiment no more than about 20 percent by weight, although the amount can be outside of these ranges. Examples of suitable waxes include (but are not limited to) those having, for example, a weight average molecular weight of in one embodiment at least about 500, and in another embodiment at least about 1,000, and in one embodiment no more than about 20,000, and in another embodiment no more than about 10,000, although the weight average molecular weight can be outside of these ranges. Examples of suitable waxes include, but are not limited to, polyolefins, such as polyethylene, polypropylene, and polybutene waxes, including those commercially available from Allied Chemical and Petrolite Corporation, for example POLYWAX™ polyethylene waxes from Baker Petrolite, wax emulsions available from Michaelman, Inc. and Daniels Products Company, EPOLENE N-15™ commercially available from Eastman Chemical Products, Inc., and VISCOL 550-P™, a low weight average molecular weight polypropylene available from Sanyo Kasei K. K., and the like; plant-based waxes, such as carnauba wax, rice wax, candelilla wax, sumacs wax, jojoba oil, and the like; animal-based waxes, such as beeswax and the like; mineral-based waxes and petroleum-based waxes, such as montan wax, ozokerite, ceresin, paraffin wax, microcrystalline wax, Fischer-Tropsch wax, and the like; ester waxes obtained from higher fatty acids and higher alcohols, such as stearyl stearate, behenyl behenate, and the like; ester waxes obtained from higher fatty acid and monovalent or multivalent lower alcohols, such as butyl stearate, propyl oleate, glyceride monostearate, glyceride distearate, pentaerythritol tetrabehenate, and the like; ester waxes obtained from higher fatty acids and multivalent alcohol multimers, such as diethyleneglycol monostearate, dipropyleneglycol distearate, diglyceryl distearate, triglyceryl tetrastearate, and the like; sorbitan higher fatty acid ester waxes, such as sorbitan monostearate and the like; and cholesterol higher fatty acid ester waxes, such as cholesteryl stearate and the like; and the like, as well as mixtures thereof. Examples of suitable functionalized waxes include, but are not limited to, amines, amides, for example AQUA SUPERSLIP 6550™, SUPERSLIP6530™ available from Micro Powder Inc., fluorinated waxes, for example POLYFLUO 190™, POLYFLUO 200™, POLYSILK 19™, POLYSILK 14™ available from Micro Powder Inc., mixed fluorinated amide waxes, for example MICROSPERSION 19™ available from Micro Powder Inc., imides, esters, quaternary amines, carboxylic acids or acrylic polymer emulsions, for example JONCRYL 74™, 89™, 130™, 537™, and 538™, all available from SC Johnson Wax, chlorinated polypropylenes and polyethylenes available from Allied Chemical and Petrolite Corporation and SC Johnson wax, and the like, as well as mixtures thereof. Mixtures and combinations of the foregoing waxes can also be used. Waxes can be included as, for example, fuser roll release agents. When included, the wax can be present in any desired or effective amount, in one embodiment at least about 1 percent by weight, and in another embodiment at least about 5 percent by weight, and in one embodiment no more than about 25 percent by weight, and in another embodiment no more than about 20 percent by weight, although the amount can be outside of these ranges.

Colorants

Examples of suitable colorants include pigments, dyes, mixtures thereof, and the like. Specific examples include, but are not limited to, carbon black; magnetite; HELIOGEN BLUE L6900, D6840, D7080, D7020, PYLAM OIL BLUE, PYLAM OIL YELLOW, and PIGMENT BLUE 1, available from Paul Uhlich and Company, Inc.; PIGMENT VIOLET 1, PIGMENT RED 48, LEMON CHROME YELLOW DCC 1026, E.D. TOLUIDINE RED, and BON RED C, available from Dominion Color Corporation, Ltd., Toronto, Ontario; NOVAPERM YELLOW FGL and HOSTAPERM PINK E, available from Hoechst; CINQUASIA MAGENTA, available from E.I. DuPont de Nemours and Company; 2,9-dimethyl-substituted quinacridone and anthraquinone dye identified in the Color Index as CI-60710, CI Dispersed Red 15, diazo dye identified in the Color Index as CI-26050, CI Solvent Red 19, copper tetra(octadecyl sulfonamido) phthalocyanine, x-copper phthalocyanine pigment listed in the Color Index as CI-74160, CI Pigment Blue, Anthrathrene Blue identified in the Color Index as CI-69810, Special Blue X-2137, diarylide yellow 3,3-dichlorobenzidene acetoacetanilides, a monoazo pigment identified in the Color Index as CI-12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, Yellow 180, Permanent Yellow FGL; Neopen Yellow 075, Neopen Yellow 159, Neopen Orange 252, Neopen Red 336, Neopen Red 335, Neopen Red 366, Neopen Blue 808, Neopen Black X53, Neopen Black X55; Pigment Blue 15:3 having a Color Index Constitution Number of 74160, Magenta Pigment Red 81:3 having a Color Index Constitution Number of 45160:3, Yellow 17 having a Color Index Constitution Number of 21105; Pigment Red 122 (2,9-dimethylquinacridone), Pigment Red 185, Pigment Red 192, Pigment Red 202, Pigment Red 206, Pigment Red 235, Pigment Red 269, combinations thereof, and the like.

The colorant is present in the toner in any desired or effective amount, in one embodiment at least about 1 percent by weight of the toner, and in another embodiment at least about 2 percent by weight of the toner, and in one embodiment no more than about 25 percent by weight of the toner, and in another embodiment no more than about 15 percent by weight of the toner, although the amount can be outside of these ranges.

In one specific embodiment, the toner contains particularly high amounts of a conductive pigment, in one specific embodiment at least about 2 percent by weight of the toner, in another embodiment at least about 6 percent by weight of the toner, and in yet another embodiment at least about 7 percent by weight of the toner, and in one embodiment no more than about 25 percent by weight of the toner, in another embodiment no more than about 20 percent by weight of the toner, and in yet another embodiment no more than about 15 percent by weight of the toner, although the amount can be outside of these range.

At least one colorant in the toner is conductive. By "conductive" is meant in one embodiment at least about $10^{-6}$ $ohm^{-1}$ $cm^{-1}$, and in another embodiment at least about $10^{-1}$ $ohm^{-1}$ $cm^{-1}$, and in one embodiment no more than about $10^{8}$ $ohm^{-1}$ $cm^{-1}$, in another embodiment no more than about $10^{7}$ $ohm^{-1}$ $cm^{-1}$, and in yet another embodiment no more than about $10^{5}$ $ohm^{-1}$ $cm^{-1}$, although the pigment conductivity can be outside of these ranges.

Examples of suitable conductive pigments include carbon black, including REGAL 330™ (Cabot), Carbon Black 5250 and 5750 (Columbian Chemicals), Sunsperse Carbon Black LHD 9303 (Sun Chemicals), and NIPEX-35 (CAS 1333-86-4) carbon black, available from Degussa; magnetite, including Mobay magnetites MO8029™ and MO8060™, Columbian magnetites MAPICO BLACK™ and surface treated magnetites, Pfizer magnetites CB4799™, CB5300™, CB5600®, and MCX6369™, Bayer magnetites BAYFERROX 8600™ and 8610™, Laxness Bayoxide® E 8706, 8708, 8709, 8710, Bayoxide® E 8707 H and 8713, Northern Pigments magnetites NP-604™ and NP608™, Magnox magnetites TMB-100™ and TMB-104™, NANOGAP magnetites, including NGAP NP FeO-2201, NGAP NP FeO-2202, NGAP NP FeO-2204, NGAP NP FeO-2205-AB, NGAP NP FeO-2206, NGAP NP FeO-2207, and the like, metallic pigments, including silver and gold sub-micron or nanoparticles, such as NANOGAP nanoparticle silver NGAP NP Ag-2103, NGAP NP Ag-2104-W, NGAP NP Ag-2106-W, NGAP NP Ag-2111, conductive pigments such as $CoAlO_4$ from nGimat™ Co. of Atlanta, Ga., $CoAl_2O_4$, Au, $TiO_2$, $CrO_2$, $SbO_2$, and $CoFe_2O_4$ nano-pigments as described by P. M. T. Cavalcantea, M. Dondib, G. Guarinib, M. Raimondob and G. Baldic in *Dyes and Pigments*, Volume 80, Issue 2, February 2009, Pages 226-232, the disclosure of which is totally incorporated herein by reference, and conductive dyes such as rhodamine dyes, or pigments that contain or can leach a conductive dye component, such as PR 81.2 rhodamine pigment, and the like, as well as mixtures thereof.

Toner Preparation

The pH of the resulting mixture can be adjusted by an acid, such as acetic acid, nitric acid, or the like. In specific embodiments, the pH of the mixture can be adjusted to from about 2 to about 4.5, although the pH can be outside of this range. Additionally, if desired, the mixture can be homogenized. If the mixture is homogenized, homogenization can be performed by mixing at from about 600 to about 4,000 revolutions per minute, although the speed of mixing can be outside of this range. Homogenization can be performed by any desired or effective method, for example, with an IKA ULTRA TURRAX T50 probe homogenizer.

Following preparation of the above mixture, an aggregating agent can be added to the mixture. Any desired or effective aggregating agent can be used to form a toner. Suitable aggregating agents include, but are not limited to, aqueous solutions of divalent cations or a multivalent cations. Specific examples of aggregating agents include polyaluminum halides such as polyaluminum chloride (PAC), or the corresponding bromide, fluoride, or iodide, polyaluminum silicates, such as polyaluminum sulfosilicate (PASS), and water soluble metal salts, including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and the like, as well as mixtures thereof. In specific embodiments, the aggregating agent can be added to the mixture at a temperature below the glass transition temperature (Tg) of the resin.

The aggregating agent can be added to the mixture used to form a toner in any desired or effective amount, in one embodiment at least about 0.1 percent by weight, in another embodiment at least about 0.2 percent by weight, and in yet another embodiment at least about 0.5 percent by weight, and in one embodiment no more than about 8 percent by weight, and in another embodiment no more than about 5 percent weight of the resin in the mixture, although the amounts can be outside of these ranges.

To control aggregation and coalescence of the particles, the aggregating agent can, if desired, be metered into the mixture over time. For example, the agent can be metered into the mixture over a period of in one embodiment at least about 5 minutes, and in another embodiment at least about 30 minutes, and in one embodiment no more than about 240 minutes, and in another embodiment no more than about 200 minutes, although more or less time can be used. The addition of the agent can also be performed while the mixture is maintained under stirred conditions, in one embodiment at least about 50 rpm, and in another embodiment at least about 100 rpm, and in one embodiment no more than about 1,000 rpm, and in another embodiment no more than about 500 rpm, although the mixing speed can be outside of these ranges, and, in some specific embodiments, at a temperature that is below the glass transition temperature of the resin as discussed above, in one specific embodiment at least about 30° C., in another specific embodiment at least about 35° C., and in one specific embodiment no more than about 90° C., and in another specific embodiment no more than about 70° C., although the temperature can be outside of these ranges.

The particles can be permitted to aggregate until a predetermined desired particle size is obtained. A predetermined desired size refers to the desired particle size to be obtained as determined prior to formation, with the particle size being monitored during the growth process until this particle size is reached. Samples can be taken during the growth process and analyzed, for example with a Coulter Counter, for average particle size. Aggregation can thus proceed by maintaining the elevated temperature, or by slowly raising the temperature to, for example, from about 40° C. to about 100° C. (although the temperature can be outside of this range), and holding the mixture at this temperature for a time from about 0.5 hours to about 6 hours, in embodiments from about hour 1 to about 5 hours (although time periods outside of these ranges can be used), while maintaining stirring, to provide the aggregated particles. Once the predetermined desired particle size is reached, the growth process is halted. In embodiments, the predetermined desired particle size is within the toner particle size ranges mentioned above.

The growth and shaping of the particles following addition of the aggregation agent can be performed under any suitable conditions. For example, the growth and shaping can be conducted under conditions in which aggregation occurs separate from coalescence. For separate aggregation and coalescence stages, the aggregation process can be conducted under shearing conditions at an elevated temperature, for example of from about 40° C. to about 90° C., in embodiments from about 45° C. to about 80° C., which may be below the glass transition temperature of the resin as discussed above.

Shell Formation

A shell can then be applied to the formed aggregated toner particles. Any resin described above as suitable for the core resin can be used as the shell resin. The shell resin can be applied to the aggregated particles by any desired or effective method. For example, the shell resin can be in an emulsion, including a surfactant. The aggregated particles described above can be combined with said shell resin emulsion so that the shell resin forms a shell over the formed aggregates. In one specific embodiment, an amorphous polyester can be used to form a shell over the aggregates to form toner particles having a core-shell configuration.

In one specific embodiment, the shell comprises the same amorphous resin or resins that are found in the core. For example, if the core comprises one, two, or more amorphous resins and one, two, or more crystalline resins, in this embodiment the shell will comprise the same amorphous resin or mixture of amorphous resins found in the core. In some embodiments, the ratio of the amorphous resins can be different in the core than in the shell.

The shell and the core both comprise a colorant. The colorant is present in the shell in any desired or effective amount, in one embodiment at least about 0.5 percent by weight of the shell, in another embodiment at least about 1 percent by weight of the shell, and in yet another embodiment at least about 2 percent by weight of the shell, and in one embodiment no more than about 15 percent by weight of the shell, in another embodiment no more than about 10 percent by weight of the shell, and in yet another embodiment no more than about 5 percent by weight of the shell, although the amount can be outside of these ranges.

In one specific embodiment, the amount of colorant in the shell is at least about 10 percent by weight of the amount of colorant in the core, in another embodiment at least about 20 percent by weight of the amount of colorant in the core, and in yet another embodiment at least about 50 percent by weight of the amount of colorant in the core, and in one embodiment the amount of colorant in the shell is no more than about 100 percent by weight of the amount of colorant in the core, in another embodiment no more than about 70 percent by weight of the amount of colorant in the core, and in yet another embodiment no more than about 60 percent by weight of the amount of colorant in the core, although the amount can be outside of these ranges.

In one specific embodiment, the shell and the core comprise the same colorant. In another specific embodiment, the shell comprises a first colorant and the core comprises a second colorant which is different from the first colorant.

In one specific embodiment, the colorant is a pigment. In another specific embodiment, the colorant is a dye. In yet another specific embodiment, the colorant is a mixture of a dye and a pigment. When the first and second colorants are different from each other, either or both colorants can be represented by any of these three embodiments.

Once the desired final size of the toner particles is achieved, the pH of the mixture can be adjusted with a base to a value in one embodiment of from about 6 to about 10, and in another embodiment of from about 6.2 to about 7, although a pH outside of these ranges can be used. The adjustment of the pH can be used to freeze, that is to stop, toner growth. The base used to stop toner growth can include any suitable base, such as alkali metal hydroxides, including sodium hydroxide and potassium hydroxide, ammonium hydroxide, combinations thereof, and the like. In specific embodiments, ethylene diamine tetraacetic acid (EDTA) can be added to help adjust the pH to the desired values noted above. In specific embodiments, the base can be added in amounts from about 2 to about 25 percent by weight of the mixture, and in more specific embodiments from about 4 to about 10 percent by weight of the mixture, although amounts outside of these ranges can be used.

Coalescence

Following aggregation to the desired particle size, with the formation of the shell as described above, the particles can then be coalesced to the desired final shape, the coalescence being achieved by, for example, heating the mixture to any desired or effective temperature, in one embodiment at least about 55° C., and in another embodiment at least about 65° C., and in one embodiment no more than about 100° C., and in another embodiment no more than about 75° C., and in one specific embodiment about 70° C., although temperatures outside of these ranges can be used, which can be below the melting point of the crystalline resin to prevent plasticization.

Higher or lower temperatures may be used, it being understood that the temperature is a function of the resins used for the binder.

Coalescence can proceed and be performed over any desired or effective period of time, in one embodiment at least about 0.1 hour, and in another embodiment at least 0.5 hour, and in one embodiment no more than about 9 hours, and in another embodiment no more than about 4 hours, although periods of time outside of these ranges can be used.

After coalescence, the mixture can be cooled to room temperature, typically from about 20° C. to about 25° C. (although temperatures outside of this range can be used). The cooling can be rapid or slow, as desired. A suitable cooling method can include introducing cold water to a jacket around the reactor. After cooling, the toner particles can be optionally washed with water and then dried. Drying can be accomplished by any suitable method for drying including, for example, freeze-drying.

Optional Additives

The toner particles can also contain other optional additives as desired. For example, the toner can include positive or negative charge control agents in any desired or effective amount, in one embodiment in an amount of at least about 0.1 percent by weight of the toner, and in another embodiment at least about 1 percent by weight of the toner, and in one embodiment no more than about 10 percent by weight of the toner, and in another embodiment no more than about 3 percent by weight of the toner, although amounts outside of these ranges can be used. Examples of suitable charge control agents include, but are not limited to, quaternary ammonium compounds inclusive of alkyl pyridinium halides; bisulfates; alkyl pyridinium compounds, including those disclosed in U.S. Pat. No. 4,298,672, the disclosure of which is totally incorporated herein by reference; organic sulfate and sulfonate compositions, including those disclosed in U.S. Pat. No. 4,338,390, the disclosure of which is totally incorporated herein by reference; cetyl pyridinium tetrafluoroborates; distearyl dimethyl ammonium methyl sulfate; aluminum salts such as BONTRON E84™ or E88™ (Hodogaya Chemical); and the like, as well as mixtures thereof. Such charge control agents can be applied simultaneously with the shell resin described above or after application of the shell resin.

There can also be blended with the toner particles external additive particles, including flow aid additives, which can be present on the surfaces of the toner particles. Examples of these additives include, but are not limited to, metal oxides, such as titanium oxide, silicon oxide, tin oxide, and the like, as well as mixtures thereof; colloidal and amorphous silicas, such as AEROSIL®, metal salts and metal salts of fatty acids including zinc stearate, aluminum oxides, cerium oxides, and the like, as well as mixtures thereof. Each of these external additives can be present in any desired or effective amount, in one embodiment at least about 0.1 percent by weight of the toner, and in another embodiment at least about 0.25 percent by weight of the toner, and in one embodiment no more than about 5 percent by weight of the toner, and in another embodiment no more than about 3 percent by weight of the toner, although amounts outside these ranges can be used. Suitable additives include, but are not limited to, those disclosed in U.S. Pat. Nos. 3,590,000, 3,800,588, and 6,214,507, the disclosures of each of which are totally incorporated herein by reference. Again, these additives can be applied simultaneously with the shell resin described above or after application of the shell resin.

The toner particles can be formulated into a developer composition. The toner particles can be mixed with carrier particles to achieve a two-component developer composition. The toner concentration in the developer can be of any desired or effective concentration, in one embodiment at least about 1 percent, and in another embodiment at least about 2 percent, and in one embodiment no more than about 25 percent, and in another embodiment no more than about 15 percent by weight of the total weight of the developer, although amounts outside these ranges can be used.

The toner particles have a circularity of in one embodiment at least about 0.920, in another embodiment at least about 0.940, in yet another embodiment at least about 0.962, and in still another embodiment at least about 0.965, and in one embodiment no more than about 0.999, in another embodiment no more than about 0.990, and in yet another embodiment no more than about 0.980, although the value can be outside of these ranges. A circularity of 1.000 indicates a completely circular sphere. Circularity can be measured with, for example, a Sysmex FPIA 2100 analyzer.

Emulsion aggregation processes provide greater control over the distribution of toner particle sizes and can limit the amount of both fine and coarse toner particles in the toner. The toner particles can have a relatively narrow particle size distribution with a lower number ratio geometric standard deviation (GSDn) of in one embodiment at least about 1.15, in another embodiment at least about 1.18, and in yet another embodiment at least about 1.20, and in one embodiment no more than about 1.40, in another embodiment no more than about 1.35, in yet another embodiment no more than about 1.30, and in still another embodiment no more than about 1.25, although the value can be outside of these ranges.

The toner particles can have a volume average diameter (also referred to as "volume average particle diameter" or "$D_{50v}$") of in one embodiment at least about 3 μm, in another embodiment at least about 4 μm, and in yet another embodiment at least about 5 μm, and in one embodiment no more than about 25 μm, in another embodiment no more than about 15 μm, and in yet another embodiment no more than about 12 μm, although the value can be outside of these ranges. $D_{50v}$, GSDv, and GSDn can be determined using a measuring instrument such as a Beckman Coulter Multisizer 3, operated in accordance with the manufacturer's instructions. Representative sampling can occur as follows: a small amount of toner sample, about 1 gram, can be obtained and filtered through a 25 micrometer screen, then put in isotonic solution to obtain a concentration of about 10%, with the sample then run in a Beckman Coulter Multisizer 3.

The toner particles can have a shape factor of in one embodiment at least about 105, and in another embodiment at least about 110, and in one embodiment no more than about 170, and in another embodiment no more than about 160, SF1*a, although the value can be outside of these ranges. Scanning electron microscopy (SEM) can be used to determine the shape factor analysis of the toners by SEM and image analysis (IA). The average particle shapes are quantified by employing the following shape factor (SF1*a) formula: $SF1*a=100\pi d^2/(4A)$, where A is the area of the particle and d is its major axis. A perfectly circular or spherical particle has a shape factor of exactly 100. The shape factor SF1*a increases as the shape becomes more irregular or elongated in shape with a higher surface area.

The characteristics of the toner particles may be determined by any suitable technique and apparatus and are not limited to the instruments and techniques indicated hereinabove.

In embodiments where the toner resin is crosslinkable, such crosslinking can be performed in any desired or effective manner. For example, the toner resin can be crosslinked during fusing of the toner to the substrate when the toner resin is crosslinkable at the fusing temperature. Crosslinking can also be effected by heating the fused image to a temperature at which the toner resin will be crosslinked, for example in a post-fusing operation. In specific embodiments, crosslinking can be effected at temperatures of in one embodiment about 160° C. or less, in another embodiment from about 70° C. to about 160° C., and in yet another embodiment from about 80° C. to about 140° C., although temperatures outside these ranges can be used.

The toner particles can have a dielectric loss value, which is a measure of conductivity of the toner particles, in one embodiment of no more than about 70, in another embodiment of no more than about 50, and in yet another embodiment of no more than about 40, although the value can be outside of these ranges.

Specific embodiments will now be described in detail. These examples are intended to be illustrative, and the claims are not limited to the materials, conditions, or process parameters set forth in these embodiments. All parts and percentages are by weight unless otherwise indicated.

Comparative Example A

A black emulsion aggregation toner was prepared at the 2 L bench scale (175 g dry theoretical toner). Two amorphous polyester emulsions (97 g of an amorphous polyester resin in an emulsion (polyester emulsion A), having a Mw of about 19,400, an Mn of about 5,000, and a Tg onset of about 60° C., and about 35% solids and 101 g of an amorphous polyester resin in an emulsion (polyester emulsion B), having a weight average molecular weight (Mw) of about 86,000, a number average molecular weight (Mn) of about 5,600, an onset glass transition temperature (Tg onset) of about 56° C., and about 35% solids), 34 g of a crystalline polyester emulsion (having a Mw of about 23,300, an Mn of about 10,500, a melting temperature (Tm) of about 71° C., and about 35.4% solids), 5.06 g surfactant (DOWFAX 2A1), 51 g of polyethylene wax in an emulsion, having a Tm of about 90° C., and about 30% solids, 96 g black pigment dispersion (NIPEX-35, obtained from Evonik Degussa, Parsippany, N.J.), and 16 g cyan pigment dispersion (Pigment Blue 15:3, about 17% solids, obtained from Sun Chemical Corporation) were mixed. Both amorphous resins were of the formula

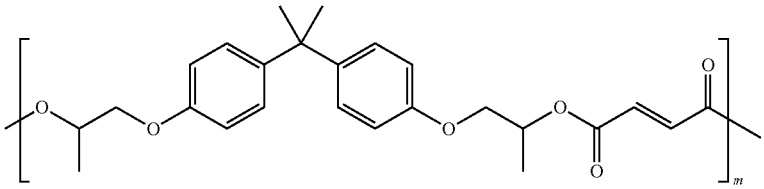

wherein m is from about 5 to about 1000. The crystalline resin was of the formula

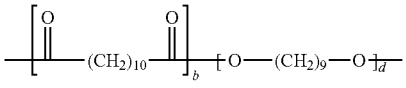

wherein b is from about 5 to about 2000 and d is from about 5 to about 2000.

Thereafter, the pH was adjusted to 4.2 using 0.3M nitric acid. The slurry was then homogenized for a total of 5 minutes at 3000-4000 rpm while adding in the coagulant (3.14 g $Al_2(SO_4)_3$ mixed with 36.1 g deionized water). The slurry was then transferred to the 2 L Buchi reactor and set mixing at 460 rpm. Thereafter, the slurry was aggregated at a batch temperature of 42° C. During aggregation, a shell comprising the same amorphous emulsions as in the core was pH adjusted to 3.3 with nitric acid and added to the batch. The batch then continued to achieve the targeted particle size. Once at the target particle size with pH adjustment to 7.8 using NaOH and EDTA, the aggregation step was frozen. The process proceeded with the reactor temperature being increased to achieve 85° C.; at the desired temperature the pH was adjusted to 6.5 using pH 5.7 sodium acetate/acetic acid buffer where the particles began to coalesce. After about two hours the particles achieved a circularity of >0.965 and were quench-cooled with ice. The toner was washed with three deionized water washes at room temperature and dried using a freeze-dryer unit. Final toner particle size, GSDv and GSDn were 5.48 μm, 1.19, 1.21, respectively. Fines (1.3-4 μm), coarse (>16 μm), and circularity were 14.03%, 0.87%, and 0.977.

Example I

The process of Comparative Example A was repeated except that during preparation of the toner core, 85 g black pigment were used instead of 96, and except that the shell also comprised 11 g of the black pigment in addition to the two amorphous polyesters. Final toner particle size, GSDv and GSDn were 5.71 μm, 1.20, 1.26, respectively. Fines (1.3-4 μm), coarse (>16 μm), and circularity were 17.47%, 0.6%, and 0.976.

Comparative Example B

A black emulsion aggregation toner was prepared at the 20 gallon pilot scale (11 g dry theoretical toner). Two amorphous emulsions (7 kg amorphous polyester A and 7 kg amorphous polyester B) containing 2% surfactant (DOWFAX 2A1), 2 kg crystalline emulsion containing 2% surfactant (DOWFAX 2A1), 3 kg wax (IGI), 6 kg black pigment (NIPEX-35), and 917 g cyan pigment (Pigment Blue 15:3 Dispersion) were mixed in the reactor, followed by adjusting the pH to 4.2 using 0.3M nitric acid. The slurry was then homogenized through a cavitron homogenizer with the use of a recirculating loop for a total of 60 minutes where during the first 8 minutes the coagulant, consisting of 2.96 g $Al_2(SO_4)_3$ mixed with 36.5 g deionized water, was added inline. The reactor rpm was increased from 100 rpm to set mixing at 300 rpm once all the coagulant was added. The slurry was then aggregated at a batch temperature of 42° C. During aggregation, a shell comprising the same amorphous emulsions as in the core was pH adjusted to 3.3 with nitric acid and added to the batch. Thereafter the batch was further heated to achieve the targeted particle size. Once at the target particle size with a pH adjustment to 7.8 using NaOH and EDTA the aggregation step was frozen. The process proceeded with the reactor temperature being increased to achieve 85° C. At the desired temperature the pH was adjusted to 6.8 using pH 5.7 sodium acetate/acetic acid buffer where the particles begin to coalesce. After about two hours the particles achieved >0.965 and were quench-cooled using a heat exchanger. The toner was washed with three deionized water washes at room temperature and dried using an Aljet "Thermajet" dryer Model 4. Final toner particle size, GSDv and GSDn were 5.31 μm, 1.22, 1.23, respectively. Fines (1.3-4 μm), coarse (>16 μm), and circularity were 22.92%, 0.05%, and 0.969.

Example II

The process of Comparative Example B was repeated except that during preparation of the toner core, 5.3 kg black pigment were used instead of 6, and except that the shell also comprised 700 g of the black pigment in addition to the two amorphous polyesters. Final toner particle size, GSDv and GSDn were 5.20 μm, 1.20, 1.23, respectively. Fines (1.3-4 μm), coarse (>16 μm), and circularity were 22.73%, 0%, and 0.972.

Toner charging results were obtained by preparing a developer at 5% toner concentration with respect to the weight of the total developer using the XEROX® 700 carrier. After conditioning separate samples overnight in a low-humidity zone (C zone) at about 10° C./15% relative humidity, and a high humidity zone (A zone) at about 28° C./85% relative humidity, the developers were charged in a Turbula mixer for 60 minutes. The toner charge was measured in the form of q/d, the charge to diameter ratio. The q/d was measured using a charge spectrograph with a 100 V/cm field, and was measured visually as the midpoint of the toner charge distribution. The charge was reported in millimeters of displacement from the zero line (mm displacement can be converted to femtocoulombs/micron (fC/μm) by multiplying by 0.092).

Also measured was dielectric loss in a custom-made fixture connected to an HP4263B LCR Meter via shielded 1 meter BNC cables. To ensure reproducibility and consistency, one gram of toner (conditioned in C-zone 24 h) was placed in a mold having a 2-inch diameter and pressed by a precision-ground plunger at about 2000 psi for 2 minutes. While maintaining contact with the plunger (which acted as one electrode), the pellet was then forced out of the mold onto a spring-loaded support, which kept the pellet under pressure and also acted as the counter-electrode. The current set-up eliminated the need for using additional contact materials (such as tin foils or grease) and also enabled the in-situ measurement of pellet thickness. Dielectric and dielectric loss were determined by measuring the capacitance (Cp) and the loss factor (D) at 100 KHz frequency and 1 VAC. The measurements were carried out under ambient conditions.

The dielectric constant was calculated as:

$$E' = [Cp(\text{pF}) \times \text{Thickness(mm)}]/[8.854 \times A\text{effective}(\text{m}^2)]$$

Here 8.854 was just the vacuum electrical permittivity epsilon (O), but in units that take into account the fact that Cp was in picofarads, not farads, and thickness was in mm (not meters). Aeffective was the effective area of the sample. Dielectric loss was=E*Dissipation factor, which was how much electrical dissipation there was in the sample (how leaky the capacitor was). We multiplied this by 1000 to simplify the values. Thus, a reported dielectric loss value of 70 indicated a dielectric loss of $70 \times 10^{-3}$, or 0.070.

Toner charging results and dielectric loss values for the toners prepared in Comparative Examples A and B and Examples I and II are shown in the table below. The low-humidity zone (C zone) is about 10° C./15% RH, while the high humidity zone (A zone) is about 28° C./85% RH.

| | A Zone | C Zone | E" × 1000 (loss) |
|---|---|---|---|
| Comparative Example A | −3.4 | −9.9 | 113 |
| Example I | −3.6 | −9.3 | 69 |
| Comparative Example B | −4.7 | −9.6 | 81 |
| Example II | −3.9 | −8.8 | 61 |

As the data indicate, the toners containing the pigment in the shell exhibited reduced dielectric loss by at least 25%, and there was relatively little change in triboelectric charging characteristics.

The toners of Comparative Example B and Example II were subjected to further testing to measure mottle and second transfer efficiency. NMF stands for Noise in Mottle Frequency, which measures 2D lightness (L*) variation at the 1-5 mm spatial scale. NMF is measured with IQAF (Image Quality Analysis Facility), which is an automated system for instrumented image quality measurements described in U.S. Pat. Nos. 6,571,000, 6,606,395, and 7,382,507, the disclosures of each of which are totally incorporated herein by reference. Test targets are flat fields with any color with a size of about 70×70 mm; smaller size areas will not give good precision (large size is needed for a reasonable precision). To perform a typical test, one first generates the image quality prints using a print pattern containing 6 different density levels comprising 100%, 80%, 60%, 40%, 20%, and 10% patches. The print is then scanned using an Epson GT30000 scanner. The scanned image is then analyzed by IQAF software and a report is generated to an Excel file for each of the 6 patches. Below is reported the NMF value for the solids (100% area coverage). Second transfer efficiency is defined as the ratio of the toner mass per unit area (TMA) on paper to the TMA on the transfer belt. A series of 0.5 cm×10 cm solid patches were sent to the printer. The printer was hard stopped during printing to get unfused images on the intermediate transfer belt and on the paper. The TMA on the belt was measured using a tape transfer method. The weight of a clear tape was first measured, followed by obtaining a whole patch of toner on the belt using the tape and weighing the tape again. The weight difference is thus the weight of the toner of one patch. TMA on belt is the ratio of the weight of the patch to the area, which was 5 $cm^2$. The TMA on the paper was measured with a blow off method. The paper was cut out with a patch on and the mass was obtained before and after the unfused toners were blown off. The weight of a patch on paper is the weight difference and TMA on paper is again the ratio of the weight of a patch to the area. The $2^{nd}$ transfer efficiency is then the ratio of the TMA on the paper to the TMA on the belt multiplied by 100 to give a percentage. The results are shown in the table below:

| | E" × 1000 (loss) | $2^{nd}$ Transfer Efficiency average | NMF |
|---|---|---|---|
| Comparative Example B | 81 | 57.25 | 100 |
| Example II | 61 | 65.75 | 72 |

Mottle as measured in A-zone with 8 weight percent toner concentration with respect to carrier and a 100% full solid area test patch While not desiring to be limited to any particular theory, it is believed that as a result of the high conductivity of the control toner having a high concentration of carbon black in the core, it exhibited relatively low transfer efficiency in A-zone conditions where the relative humidity was very high (85%). We believe the effect was seen only in A-zone because the conductivity of the toner was further increased by the adsorption of water in addition to the high carbon black loading. In addition, there was more water in the paper, increasing the conductivity of the toner and paper in the second transfer step from the intermediate transfer belt to the paper. Finally, low charge in A-zone can also decrease transfer efficiency. Thus, the critical stress case for the effect of toner conductivity was seen in A-zone. As a result of the poor transfer the image quality degraded, especially the mottle. This machine test thus illustrated a stress test case for transfer. As seen in the table above, the machine test shows that with reduced dielectric loss there was improved second transfer efficiency, a 15% increase from the control value, and mottle was reduced 28%. Further, as the FIGURE shows, triboelectric charging was consistently higher for the toner of Example II compared to that of Comparative Example B during the print test in A-zone by an average of 4 tribo units, wherein a tribo unit is defined as one microcoulomb of charge per gram of toner, which is very desirable to improve background and latitude performance. For the toner of Comparative Example B, charge was lower and dropped below 20 tribo units at 12 weight percent toner concentration with respect to the developer (toner plus carrier), which is minimally desirable performance.

Example III

The processes of Comparative Example A and Example I are repeated except that instead of the black pigment, Mapico® Black Iron Oxide is used. It is believed that similar results will be observed.

Example IV

The processes of Comparative Example A and Example I are repeated except that instead of the black pigment, NANOGAP nanoparticle silver is used. It is believed that similar results will be observed.

Example V

The process of Example I is repeated except that instead of the black pigment, Magnox magnetites TMB-100™ is used. It is believed that similar results will be observed.

Example VI

The process of Example I is repeated except that instead of the black pigment, CoAlO4 from nGimat™ Co. is used. It is believed that similar results will be observed.

Example VII

Into a 2 L beaker are added 475 g of deionized water, 47 g Polywax725 (commercially available from Baker Petrolite), 235.8 g of an emulsion polymerization styrene-butyl acrylate latex with a Tg of 50-55° C. (42% solids) prepared as described in U.S. Pat. Nos. 5,853,943, 5,922,501, and 5,928,829, the disclosures of each of which are totally incorporated herein by reference, and 80 g (17.0% solids) of a black pigment NIPEX-35. A flocculant solution comprising 2.6 g polyaluminum chloride mixed with 24 g deionized water is added to the mixture while homogenizing at 3,000-4,000 rpm. The mixture is subsequently transferred to a 2 L Buchi reactor and heated to 52° C. for aggregation at 850 rpm. The particle size is monitored with a Coulter Counter until the core particles reach a volume average particle size of 4.8 μm with a GSD of 1.21. Thereafter, 114 g of the above emulsion polymerization styrene-butyl acrylate latex containing 12 g of the black pigment is added as a shell, resulting in core/shell structured particles. The reactor is further heated to achieve a particle size of 5.8 μm with a GSD of 1.21. Subsequently, the pH of the reaction slurry is increased to 5.6 using NaOH, followed by addition of 4 g EDTA to freeze the toner particle growth. After freezing particle growth, the reaction mixture is heated for coalescence and once at the desired coalescence temperature the slurry pH is adjusted to 4.8 with 0.3M nitric acid. The toner slurry is then cooled to room temperature, separated by sieving (25 μm), filtered, washed, and freeze dried.

Other embodiments and modifications of the present invention may occur to those of ordinary skill in the art subsequent to a review of the information presented herein; these embodiments and modifications, as well as equivalents thereof, are also included within the scope of this invention.

The recited order of processing elements or sequences, or the use of numbers, letters, or other designations therefor, is not intended to limit a claimed process to any order except as specified in the claim itself.

What is claimed is:

1. A toner which comprises core-shell toner particles comprising a first conductive pigment and a second conductive pigment wherein the total amount of the first conductive pigment plus the second conductive pigment is at least about 7 percent by weight of the toner wherein a percentage of the total amount of pigment is present in the shell, the toner particles comprising:

(a) the core comprising:

(1) a first resin: and (2) the first conductive pigment; and (b) the shell comprising:

(1) a second resin; and (2) the second conductive pigment present at no more than about 5 percent by weight of the shell.

2. A toner according to claim 1 wherein the first conductive pigment is the same as the second conductive pigment.

3. A toner according to claim 1 wherein the first conductive pigment and the second conductive pigment both comprise carbon black.

4. A toner according to claim 1 which exhibits a dielectric loss of no more than about 70.

5. A toner according to claim 1 which exhibits a dielectric loss that is reduced as compared to a toner particle wherein the total pigment is in the core.

6. A toner according to claim 1 wherein the total amount of the first conductive pigment plus the second conductive pigment is about 7 to about 25 percent by weight of the toner.

7. A toner according to claim 1 wherein the first resin comprises an amorphous resin and the second resin is the same as the first resin.

8. A toner according to claim 7 wherein the first resin comprises a mixture of two or more amorphous resins and the second resin comprises a mixture of the same two or more amorphous resins.

9. A toner according to claim 8 wherein the core further comprises a third resin which is a crystalline resin.

10. A toner according to claim 9 wherein the first, second, and third resins all comprise polyesters.

11. A toner according to claim 1 wherein the first resin comprises an amorphous styrene-butyl acrylate resin and the second resin comprises an amorphous styrene-butyl acrylate resin.

12. A toner according to claim 1 where in the second conductive pigment has a conductivity of at least about $10^{-6}$ ohm $cm^{-1}$.

13. A toner according to claim 1 where in the second conductive pigment has a conductivity of at least about $10^{-1}$ ohm $cm^{-1}$.

14. A toner according to claim 1 wherein the shell contains the second conductive pigment in an amount of at least about 0.5 percent by weight of the shell.

15. A toner according to claim 1 wherein the shell contains the second conductive pigment in an amount of from about 10 to about 20 percent by weight of the amount of the first conductive pigment in the core.

16. A toner according to claim 1 wherein the toner is an emulsion aggregation toner.

17. A toner according to claim 1 prepared by a process which comprises:

(A) forming, a first emulsion comprising the first resin;

(B) contacting the first emulsion with a dispersion comprising the first conductive pigment, an optional wax, and an optional coagulant to form a mixture;

(C) aggregating small particles in the mixture to form a plurality of larger aggregates;

(D) forming a second emulsion comprising the second resin and the second conductive pigment in the emulsion;

(E) contacting the larger aggregates with the second emulsion to form a shell over the larger aggregates; and (F) coalescing the larger aggregates to form toner particles.

18. A toner which comprises core-shell toner particles comprising a first conductive pigment and a second conductive pigment wherein the total amount of the first conductive pigment plus the second conductive pigment is at least about 7 percent by weight of the toner wherein a percentage of the total amount of pigment is present in the shell, the toner particles comprising:

(a) the core comprising:

(1) a first amorphous resin;

(2) a crystalline resin; and (3) the first conductive pigment; and (b) the shell comprising:

(1) a second amorphous resin; and (2) the second conductive pigment present at no more than about 5 percent by weight of the shell; and wherein the toner is an emulsion aggregation toner; said toner exhibiting a dielectric loss that is reduced as compared to a toner particle wherein the total pigment is in the core.

19. A toner which comprises core-shell toner particles comprising a first conductive pigment and a second conductive pigment wherein the total amount of the first conductive pigment plus the second conductive pigment is at least about 7 percent by weight of the toner wherein a percentage of the total amount of pigment is present in the shell, the toner particles comprising:

(a) the core comprising:

(1) a first amorphous polyester resin;

(2) a crystalline polyester resin; and (3) the first conductive pigment; and (b) the shell comprising:

(1) a second amorphous polyester resin; and (2) the second conductive pigment present at no more than about 5 percent by weight of the shell; and wherein the toner is an emulsion aggregation toner; said toner exhibiting a dielectric loss that is reduced by about at least 25 percent as compared to a toner particle wherein the total pigment is in the core; wherein the first conductive pigment is the same as the second conductive pigment; and wherein the first amorphous polyester resin is the same as the second amorphous polyester resin.

* * * * *